US008928218B2

(12) United States Patent
Wei et al.

(10) Patent No.: US 8,928,218 B2
(45) Date of Patent: Jan. 6, 2015

(54) DIELECTRIC BARRIER DISCHARGE LAMP AND FABRICATION METHOD THEREOF

(71) Applicant: Industrial Technology Research Institute, Hsinchu (TW)

(72) Inventors: Bee-Yu Wei, Hsinchu (TW); Jen-Hung Hsu, Miaoli County (TW); Ming-Kai Hsu, Nantou County (TW); Chun-Mu Chen, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 40 days.

(21) Appl. No.: 13/855,729

(22) Filed: Apr. 3, 2013

(65) Prior Publication Data

US 2014/0125217 A1 May 8, 2014

(30) Foreign Application Priority Data

Nov. 5, 2012 (TW) ..... 101141027 A

(51) Int. Cl.
*H01J 1/62* (2006.01)
*H01J 9/26* (2006.01)

(52) U.S. Cl.
CPC ..... *H01J 9/266* (2013.01)
USPC ..... 313/491; 313/607

(58) Field of Classification Search
USPC ..... 313/491, 607
See application file for complete search history.

(56) References Cited

U.S. PATENT DOCUMENTS 4,837,484 A 6/1989 Eliasson et al.
8,212,478 B2 7/2012 Greuel et al.
2002/0130280 A1 9/2002 Reber
2005/0218775 A1 10/2005 Kling et al.
2010/0244688 A1 * 9/2010 Braun et al. ..... 313/631

FOREIGN PATENT DOCUMENTS

| | | |
|---|---|---|
| CN | 101878518 | 11/2010 |
| JP | 11265689 | 9/1999 |
| JP | 2001283785 | 10/2001 |
| JP | 2002110102 | 4/2002 |
| TW | 493202 | 7/2002 |
| TW | 580722 | 3/2004 |
| TW | I287820 | 10/2007 |
| TW | 201112305 | 4/2011 |
| TW | 201230138 | 7/2012 |

OTHER PUBLICATIONS

"Office Action of Taiwan Counterpart Application", issued on Sep. 22, 2014, p. 1-p. 9.

* cited by examiner

*Primary Examiner* — Mary Ellen Bowman
(74) *Attorney, Agent, or Firm* — Jianq Chyun IP Office

(57) ABSTRACT

A dielectric barrier discharge lamp includes a lamp tube, a discharge gas, a support member, a first electrode, and a second electrode. The lamp tube has a first and a second sealed end. The discharge gas is filled in the lamp tube. The support member is disposed at the first sealed end and extended toward the inside of the lamp tube. The support member has an accommodating space with its opening facing the inside of the lamp tube. The first electrode is disposed in the lamp tube. A first terminal of the first electrode passes through the opening of the accommodating space. A gap exists between an end of the first terminal of the first electrode and a closed end of the accommodating space. A second terminal of the first electrode penetrates and is closely fitted with the second sealed end. The second electrode is disposed outside the lamp tube.

27 Claims, 10 Drawing Sheets

DIELECTRIC BARRIER DISCHARGE LAMP AND FABRICATION METHOD THEREOF

CROSS-REFERENCE TO RELATED APPLICATION

This application claims the priority benefit of Taiwan application serial no. 101141027, filed on Nov. 5, 2012. The entirety of the above-mentioned patent application is hereby incorporated by reference herein and made a part of this specification.

TECHNICAL FIELD

The technical field generally relates to a lamp and a fabrication method thereof, and more particularly, to a dielectric barrier discharge lamp and a fabrication method thereof.

BACKGROUND

In a dielectric barrier discharge lamp, a discharge gas is excited based on the gas discharge theory to convert electric energy into light energy. Aforementioned discharge gas may be an inert gas, such as Xe, Ar, or Kr, or a halogen gas, such as $F_2$ or $Cl_2$. In a dielectric barrier discharge lamp, an AC voltage can be applied to different discharge gases through a plurality of electrodes, and the different excited discharge gases can generate light beams of different wavelengths. Accordingly, the dielectric barrier discharge lamp can be used for many different purposes. For example, a dielectric barrier discharge lamp filled with Xe can generate a light beam having a wavelength of 172 nm. Because this light beam can dissolve organic compounds on electronic parts, the dielectric barrier discharge lamp can be used for cleaning electronic parts. In other words, besides being used as illuminating light source, dielectric barrier discharge lamps are also broadly used in the industrial, agricultural, medical, and scientific fields.

In a dielectric barrier discharge lamp, because an AC voltage is applied to the discharge gas, so as to generate the illuminating light beam, by using electrodes, it is very important to provide a uniform light source through the design of the electrodes. Conventionally, the electrodes are usually disposed on inner and outer surfaces of a double-layered lamp tube, and an AC voltage is applied to the electrodes for stimulating the discharge gas between the electrodes to generate the illuminating light beam. However, this technique offers a high cost. In addition, as for a single-layered lamp tube, while placing an inner electrode in a lamp tube, if both ends of the electrode are fixed to the lamp tube, the metal electrode may be deformed or twisted when it is heated and expands. As a result, unsatisfactory illumination uniformity may occur or the dielectric barrier discharge lamp may be damaged. Thereby, there is still a lot of space for improvement in the present design of dielectric barrier discharge lamp.

SUMMARY

Accordingly, the disclosure is directed to a dielectric barrier discharge lamp. The dielectric barrier discharge lamp has a simple structure and is easy to assemble, and a lamp tube is prevented from being damaged by thermal expansion of electrodes in the dielectric barrier discharge lamp. Thereby, a uniform illuminating light beam can be generated and an optimal illumination effect can be achieved.

The disclosure is directed to a fabrication method of a dielectric barrier discharge lamp. The dielectric barrier discharge lamp offers a stable illumination quality, in which electrodes are precisely positioned in a lamp tube, and the lamp tube is prevented from being damaged by thermal expansion of the electrodes.

The disclosure is directed to another fabrication method of a dielectric barrier discharge lamp, in which the fabrication of the dielectric barrier discharge lamp is simplified through an assembly technique, and a lamp tube is prevented from being damaged by thermal expansion of electrodes in the dielectric barrier discharge lamp.

An embodiment of the disclosure provides a dielectric barrier discharge lamp. The dielectric barrier discharge lamp includes a lamp tube, a discharge gas, a support member, a first electrode, and a second electrode. The lamp tube has a first sealed end and a second sealed end. The discharge gas is filled in the lamp tube. The support member is disposed at the first sealed end of the lamp tube and extended from the first sealed end toward the inside of the lamp tube. Besides, the support member has an accommodating space, and an opening of the accommodating space faces the inside of the lamp tube. The first electrode is disposed from inside to outside of the lamp tube. A first terminal of the first electrode passes through the opening of the accommodating space so that a part of the first electrode is in the accommodating space. A gap exists between the end of the first terminal of the first electrode and the closed end of the accommodating space. A second terminal of the first electrode penetrates through the second sealed end of the lamp tube and is closely fitted with the second sealed end. The second electrode is disposed outside the lamp tube.

An embodiment of the disclosure provides a fabrication method of a dielectric barrier discharge lamp. The fabrication method includes following steps. A lamp tube, a first electrode, a first side tube, and a second side tube are provided. A first sealed end and a second sealed end are formed at both ends of the lamp tube. The first side tube is inserted into the first sealed end of the lamp tube and advanced toward the inside of the lamp tube for a predetermined distance, and an outer surface of the first side tube is connected to the first sealed end to form a tube-shaped support member inside the lamp tube. An opening of the second side tube is fixed to the second sealed end of the lamp tube, and the second side tube and the lamp tube are internally connected with each other. The first electrode is placed and fixed at the second sealed end through the inside of the second side tube, so that a part of the first electrode is outside the lamp tube while another part of the first electrode is inside the support member. A gap exists between the end of the first terminal of the first electrode and a closed end of an accommodating space of the support member located at the first sealed end. The second side tube is sealed so that the second side tube and the first electrode are closely fitted with each other. The inside of the lamp tube is vacuum degassed and then filled with a discharge gas through the first side tube. The first side tube is sealed to form a protruding portion at the first sealed end.

An embodiment of the disclosure provides a fabrication method of a dielectric barrier discharge lamp. The fabrication method includes following steps. A lamp tube, a first electrode, a first side cover, and a second side cover are provided. The lamp tube has a side discharging vent. Herein the first side cover has a support member with an accommodating space, and the first electrode is closely fixed to and penetrates the second side cover. A first sealed end is formed at one end of the lamp tube, and the first side cover is fixed at the first sealed end. The support member of the first side cover is extended from the first sealed end toward the inside of the lamp tube, where an opening of the accommodating space faces the inside of the lamp tube. A second sealed end is formed at the end of the lamp tube opposite to the first sealed end, and the second side cover is fixed to the second sealed end, and the first electrode penetrates the second sealed end. A first terminal of the first electrode passes through the opening of the accommodating space, so that a part of the first electrode is in the support member, and a gap exists between an end of the first terminal of the first electrode and a closed end of the support member. A second terminal of the first electrode is toward outside of the lamp tube. The inside of the lamp tube is vacuum degassed and then filled with a discharge gas through the side discharge of the lamp tube. The side discharging vent is sealed to form a protruding portion.

As described above, embodiments of the disclosure provide a dielectric barrier discharge lamp and a fabrication method thereof. In the dielectric barrier discharge lamp, a part of a first electrode in a lamp tube is in an accommodating space of a support member, and a gap is kept between an end of the first electrode and a closed end of the accommodating space. Besides the purpose of supporting the first electrode, a space is reserved for the support member so that the lamp tube is prevented from being twisted or compressed when the first electrode is heated and expands. Thus, the dielectric barrier discharge lamp offers optimal illumination uniformity even when first electrode is heated and expands.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

Figure 1A:
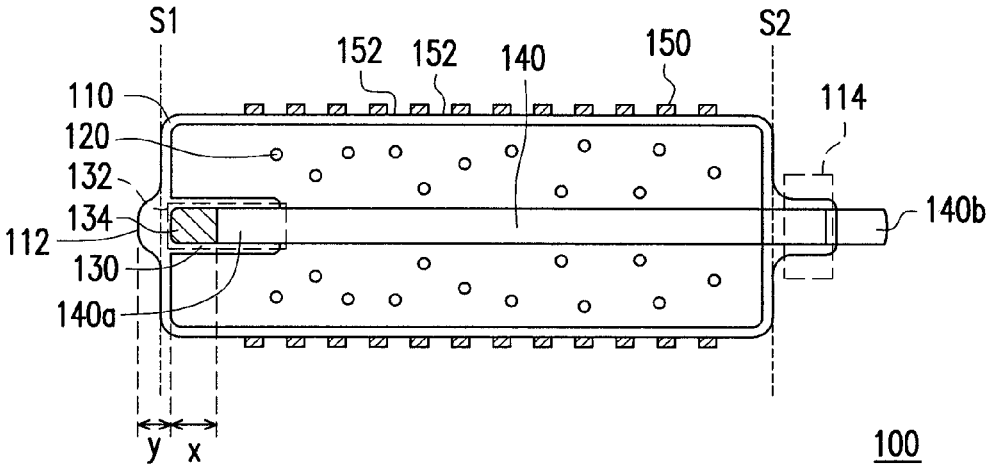
FIG. 1A is a diagram of a dielectric barrier discharge lamp according to an embodiment of the disclosure.

FIG. 1A is a diagram (i.e., a cross-sectional view) of a dielectric barrier discharge lamp according to an embodiment of the disclosure. Referring to FIG. 1A, the dielectric barrier discharge lamp 100 includes a lamp tube 110, a discharge gas 120, a support member 130, a first electrode 140, and a second electrode 150. The lamp tube 110 is made of quartz, glass, or any other light-transmissive material. The lamp tube 110 has a first sealed end S1 and a second sealed end S2, and the discharge gas 120 is filled in the lamp tube 110. The support member 130 is disposed at the first sealed end S1 and is extended from the first sealed end S1 toward the inside of the lamp tube 110. The support member 130 has an accommodating space 132, and an opening of the accommodating space 132 faces the inside of the lamp tube 110. The first electrode 140 is disposed from inside to outside of the lamp tube 110. The first terminal 140*a* of the first electrode 140 passes through the opening of the accommodating space 132 so that a part of the first electrode 140 is in the accommodating space 132. However, the part of the first electrode 140 in the accommodating space 132 does not completely occupy the entire accommodating space 132. Instead, a gap 134 (the area in FIG. 1A indicated with diagonal lines) is maintained. Namely, the gap 134 exists between an end of the first terminal 140*a* of the first electrode 140 and the closed end of the accommodating space 132. The second terminal 140*b* of the first electrode 140 penetrates the second sealed end S2 to outside of the lamp tube 110 and is closely fitted with the second sealed end S2. In addition, the dielectric barrier discharge lamp 100 has a second electrode 150 disposed outside the lamp tube 110.

Figure 1B:
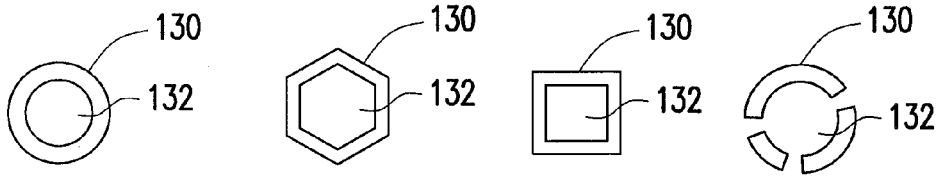
FIG. 1B illustrates the cross-sectional views of different types of support members 130 according to an embodiment of the disclosure.

As described above, in the present embodiment, the first electrode 140 is disposed from inside to outside of the lamp tube 110, and the first terminal 140*a* of the first electrode 140 is placed into the accommodating space 132 of the support member 130 so that a part of the first electrode 140 is in the accommodating space 132 and is loosely fitted with the support member 130. To be specific, the cross-sectional area of the accommodating space 132 is slightly greater than that of the first electrode 140, so that the first electrode 140 can still move around in the accommodating space 132 of the support member 130. In addition, the second terminal 140*b* of the first electrode 140 directly passes through the second sealed end S2 and is closely fitted and fixed to the second sealed end S2, so that the first electrode 140 is disposed in the dielectric barrier discharge lamp 100. FIG. 1B illustrates the cross-sectional views of different types of support members 130 according to an embodiment of the disclosure. As shown in FIG. 1B, the opening of the accommodating space 132 facing the inside of the lamp tube 110 may be in a circular or polygonal (for example, square or hexagonal) shape, and the support member 130 may be a discontinuous frame (for example, the support member 130 at the rightmost pat of FIG. 1B.

Besides being used for the supporting and positioning effects, the support member 130 in the dielectric barrier discharge lamp 100 is further used for dealing with the thermal expansion of the first electrode 140. To be specific, a dielectric barrier discharge lamp in operation usually constantly generates heat due to the gas discharge effect. Accordingly, the temperature of the first electrode (also referred to as an inner electrode) in the lamp tube continuously increases. Because the thermal expansion coefficient of the first electrode (for example, metal) is usually much higher than that of the lamp tube (for example, quartz glass), when the lamp is in operation, the first electrode is heated and accordingly about to expand. In this case, however, if both ends of the first electrode are respectively coupled to the two sealed ends of the lamp tube, since this expanding is restricted by the two sealed ends of the lamp tube, it will result in bending of the first electrode and also produce an internal stress on the lamp tube and even may cause the lamp tube to break. Thus, the lifespan of the lamp tube is shortened. Additionally, if there is no space for the first electrode to expand when it is heated, the first electrode may be pressed by the two sealed ends and sag. As a result, uneven discharge may be produced in the lamp tube, and accordingly the illumination of the lamp tube may be non-uniform. For example, a lamp tube is usually made of quartz or glass, and the thermal expansion coefficient thereof is about $5\sim80\times10^{-7}/°$ C. The first electrode is usually made of a metal, and the thermal expansion coefficient thereof is about $45\sim200\times10^{-7}/°$ C. Thus, the expansion rate of the heated first electrode is greater than that of the heated lamp tube. As a result, the first electrode is deformed in the lamp tube, which affects the illumination of the lamp tube.

In the present embodiment, besides being loosely fitted with the support member 130, a gap 134 exists between the first terminal 140*a* of the first electrode 140 in the support member 130 and the closed end of the accommodating space 132 in the support member 130. The gap 134 is configured to accommodate the expansion of the first electrode 140 when the first electrode 140 is heated, such that deformation of the first electrode 140 in the lamp tube 110 is prevented. It should be noted that in the present embodiment, the length x of the gap 134 can be determined according to different standards and when the dielectric barrier discharge lamp 100 is not in use (i.e., no thermal expansion of the first electrode 140 is produced).

The major consideration in determining the length x of the gap 134 is the length variation of the first electrode 140 when it is heated and expands. In other words, within a predetermined temperature range (i.e., the possible temperature increment when the dielectric barrier discharge lamp 100 is in operation), the length x of the gap 134 when the dielectric barrier discharge lamp 100 is not in operation should be greater than the length variation of the first electrode 140 caused by thermal expansion. This will be explained below with an example.

Herein it is assumed that the first electrode 140 is made of tungsten and the lamp tube 110 and the support member 130 are made of quartz glass. The thermal expansion coefficient of tungsten is $4.5\times10^{-6}/°$ C., and the thermal expansion coefficient of quartz glass is $0.5\times10^{-6}/°$ C. Besides, the length of the first electrode 140 is 150 mm, and the temperature variation from that the dielectric barrier discharge lamp 100 is not in operation to that the dielectric barrier discharge lamp 100 is in operation is assumed to be 1000° C. Thus, when the dielectric barrier discharge lamp 100 is in operation, the expansion of the first electrode 140 in relation to the lamp tube 110 and the support member 130 can be calculated as:

$$\Delta L=(4.5\times10^{-6}-0.5\times10^{-6})\times150\text{ mm}\times1000°\text{ C}. \quad (1)$$

The expansion quantity ΔL is about 0.6 mm. Thus, when the dielectric barrier discharge lamp 100 is fabricated, the length x of the gap 134 can be set to at least 1 mm (for example, 1 mm). Accordingly, when the lamp tube 110 is in use, the thermal expansion (for example, 0.6 mm) of the first electrode 140 can be accommodated by the gap 134. However, the determination of the length x of the gap 134 is not limited to that described above, and those applying the present embodiment may also determine the length x of the gap 134 in different manners (for example, the length x of the gap 134 is determined to be greater than a half of the external diameter of the lamp tube 110). It should be noted that the length x of the gap 134 should be determined based on the thermal expansion quantity of the first electrode 140.

In the embodiment illustrated in FIG. 1A, the accommodating space 132 of the dielectric barrier discharge lamp 100 is a tube-shaped space, and the accommodating space 132 and the lamp tube 110 have a same axis. In other words, through the disposition of the support member 130, the accommodating space 132 is located at the center of the lamp tube 110, and the first electrode 140 has the same axis as the lamp tube 110. Additionally, the dielectric barrier discharge lamp 100 further has a protruding portion 112. The protruding portion 112 is on the lamp tube 110 and protrudes towards the outside of the lamp tube 110. During the fabrication of the dielectric barrier discharge lamp 100, an opening (for example, a side tube) is formed on the lamp tube 110 to vacuum degas and fill the discharge gas 120 to the inside of the lamp tube 110, and after the gas filling process is completed, the opening is sealed to form the protruding portion 112. In FIG. 1A, the protruding portion 112 is on the axis of the lamp tube 110 and protrudes from the first sealed end S1 toward the outside of the lamp tube 110. In the present embodiment, the sum of the length y of the protruding portion 112 and the length x of the gap 134 is greater than a half of the external diameter of the lamp tube 110, so that enough space is reserved for the thermal expansion of the first electrode 140, and the first electrode 140 is prevented from getting too close to the first sealed end S1 (which may cause an AC current to be generated between the first electrode 140 and any metal material (not shown) outside the first sealed end S1 and accordingly the discharge gas 120 between the two to discharge abnormally).

The second terminal 140*b* of the first electrode 140 penetrates the second sealed end S2 to outside of the lamp tube 110, and the first electrode 140 itself is closely fitted and fixed to the second sealed end S2. Several techniques can be designed to closely fit and fix the first electrode 140 to the second sealed end S2, and one of the techniques is illustrated in FIG. 1A. Referring to FIG. 1A, the lamp tube 110 has a transition glass layer 114 at the second sealed end S2 and/or on the first electrode 140. The first electrode 140 is a rod-shaped conductor, and the second terminal 140*b* of the first electrode 140 is closely fitted and fixed to the second sealed end S2 through the transition glass layer 114. To be specific, when the first electrode 140 penetrates the second sealed end S2 to outside of the lamp tube 110, the difference between the thermal expansion coefficients of the materials of the lamp tube 110 and the first electrode 140 may cause the first electrode 140 to damage the lamp tube 110 or change the closely fitted state of the lamp tube 110 and the first electrode 140 at the second sealed end S2 when the dielectric barrier discharge lamp 100 is in operation. Thus, by covering the first electrode 140 with a series of glass material layers having different thermal expansion coefficients to form the transition glass layer 114, the difference between the thermal expansion coefficients of the first electrode 140 and the lamp tube 110 at the second sealed end S2 is reduced, and accordingly the closely fitted state is maintained. For example, the transition glass layer 114 may be composed of different glass layers having thermal expansion coefficients $1\times10^{-6}/°$ C., $1.5\times10^{-6}/°$ C., $2\times10^{-6}/°$ C., $2.5\times10^{-6}/°$ C., $3\times10^{-6}/°$ C., $3.3\times10^{-6}/°$ C., and $3.9\times10^{-6}/°$ C.

Figure 1C:
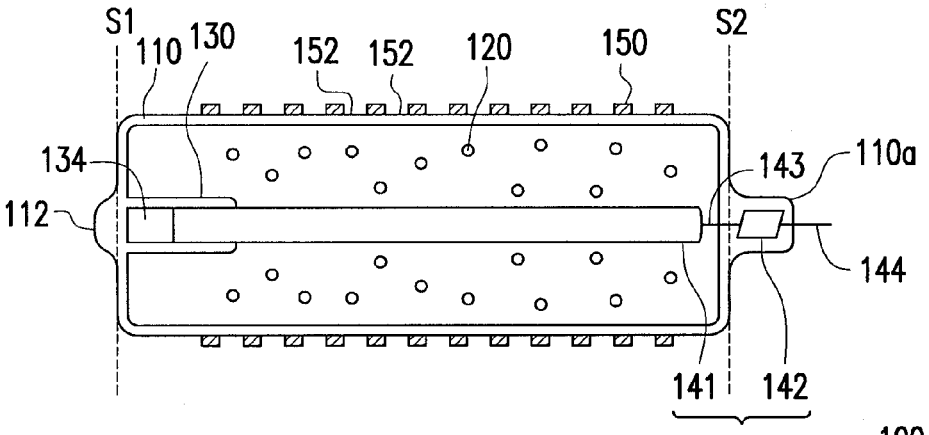
FIG. 1C is a diagram of a dielectric barrier discharge lamp according to another embodiment of the disclosure.

Another technique for maintaining the closely fitted state between the first electrode 140 and the second sealed end S2 is illustrated in FIG. 1C. FIG. 1C is a diagram of a dielectric barrier discharge lamp according to another embodiment of the disclosure. The first electrode 140 in the lamp tube 110 includes a rod-shaped conductor 141 and a plate-shaped conductor 142. In FIG. 1C, the rod-shaped conductor 141 and the plate-shaped conductor 142 are electrically connected with each other through a small metal rod 143, and the plate-shaped conductor 142 is further electrically connected with another small metal rod 144 and extended out of the lamp tube 110 through the small metal rod 144. However, it should be noted that the electrical connection between the rod-shaped conductor 141 and the plate-shaped conductor 142 is not limited to that illustrated in FIG. 1C. Instead, the rod-shaped conductor 141 and the plate-shaped conductor 142 may also be electrically connected with each other trough direct contact or small conductive lines. FIG. 1C also show that a part of the lamp tube 110*a* at the second sealed end S2 is directly compressed to closely cover the plate-shaped conductor 142, so that the first electrode 140 is closely fitted and fixed to the second sealed end S2. The dispositions of other elements can be referred to descriptions related to FIG. 1A therefore will not be described herein.

In either the embodiments illustrated in FIG. 1A or the embodiment illustrated in FIG. 1C, the dielectric barrier discharge lamp 100 includes a second electrode 150 disposed outside the lamp tube 110. An AC voltage is applied to the discharge gas 120 through the first electrode 140 and the second electrode 150, so that the discharge gas 120 in the dielectric barrier discharge lamp 100 is excited and emits light and an illumination effect of the dielectric barrier discharge lamp 100 is achieved. Besides the rod-shaped conductor in FIG. 1A and the rod-shaped and plate-shaped conductors in FIG. 1C, the first electrode may also be simply a plate-shaped conductor or a combination of several rod-shaped conductors and several plate-shaped conductors which are electrically connected with each other. Moreover, referring to FIG. 1A and FIG. 1C, the second electrode 150 is formed by wrapping the external surface of the lamp tube 110 with a metal conductive film or wire and have a plurality of light-transmissive openings 152. The light-transmissive openings 152 may be in hexagonal or any other polygonal shape such that the light emitted by the dielectric barrier discharge lamp 100 can be radiated outside the lamp tube 110 through the light-transmissive openings 152.

The first electrode 140 may be made of one or an alloy of Cu, Ni, Cr, Mo, Ag, Pt, Fe, Ti, W, and Co, and the second electrode 150 may be made of one or an alloy of Cu, Ni, Cr, Au, Mo, Ag, Pt, Fe, Ti, W, and Co. In addition, the discharge gas 120 may be gaseous Hg, He gas, Ne gas, Ar gas, Kr gas, Xe gas, Rn gas, N gas, hydrogen selenide gas, deuterium, F2 gas, Cl2 gas, Br gas, iodine gas, or a mixture of at least two of aforementioned gases.

Figure 1D:
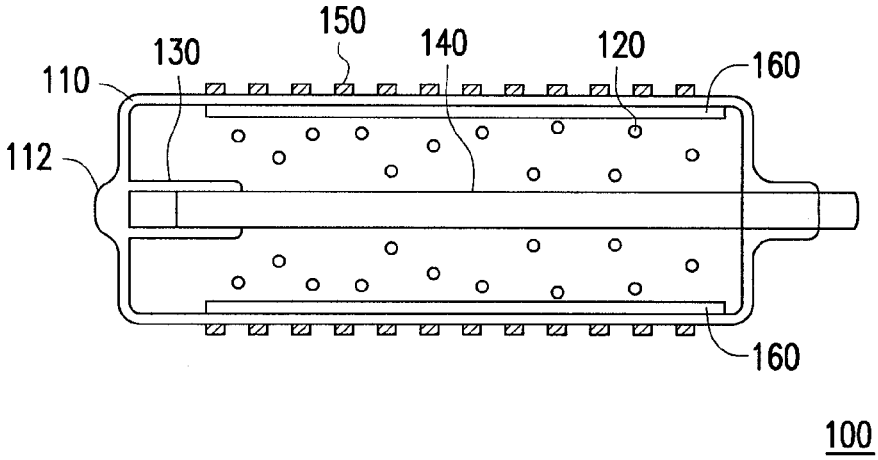
FIG. 1D is a diagram of a dielectric barrier discharge lamp according to yet another embodiment of the disclosure.

FIG. 1D is a diagram of a dielectric barrier discharge lamp according to yet another embodiment of the disclosure. In order to allow the dielectric barrier discharge lamp 100 to provide lights of different wavelengths, a phosphor coating 160 is applied on the inner surface of the lamp tube 110. However, in other embodiments, the phosphor coating 160 may also be applied on the outer surface of the lamp tube 110 to achieve the same effect. When the dielectric barrier discharge lamp 100 emits light, the phosphor coating 160 is excited by the light emitted from inside the lamp tube 110, so that an emission spectrum related to the characteristic of the phosphor coating 160 is produced. Thereby, by selecting different types of phosphor coating 160, illumination of different wavelengths can be provided.

Figure 1E:
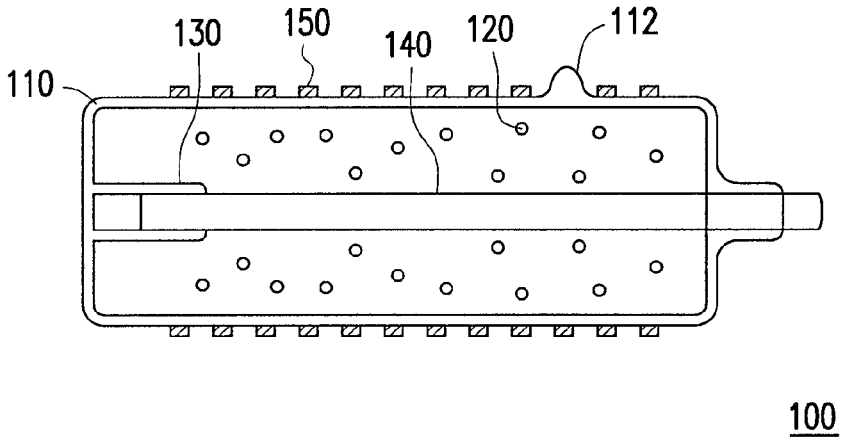
FIG. 1E is a diagram of a dielectric barrier discharge lamp according to still another embodiment of the disclosure.

FIG. 1E is a diagram of a dielectric barrier discharge lamp according to still another embodiment of the disclosure. The protruding portion 112 may be formed on the sidewall of the lamp tube 110 instead of on the axis of the lamp tube 110. Referring to FIG. 1E, during the fabrication process of the dielectric barrier discharge lamp 100, an opening (for example, a side discharging vent) is formed on the sidewall of the lamp tube 110 to vacuum degas and fill the discharge gas 120 into the lamp tube 110. In other words, the lamp tube 110 has a side discharging vent. After the gas filling process is completed, the opening is sealed to form the protruding portion 112. Other aspects of the dielectric barrier discharge lamp 100 can be referred to descriptions of foregoing embodiment therefore will not be described herein.

Figure 2A:
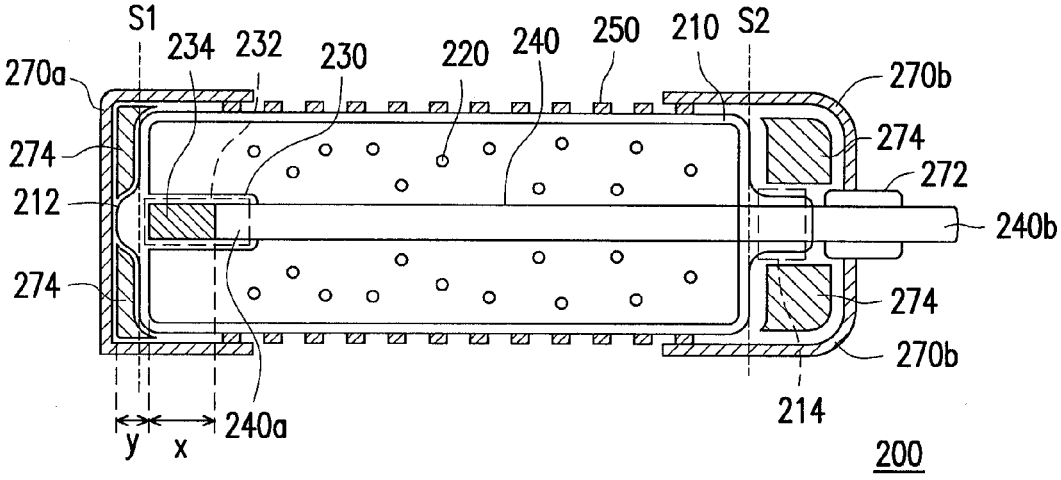
FIG. 2A is a diagram of a dielectric barrier discharge lamp according to an embodiment of the disclosure.

FIG. 2A is a diagram of a dielectric barrier discharge lamp according to an embodiment of the disclosure. The difference between the dielectric barrier discharge lamp 200 in the present embodiment and the dielectric barrier discharge lamp 100 in FIG. 1A is that the dielectric barrier discharge lamp 200 further includes a metal cap 270*a* covering the first sealed end S1 of the lamp tube 210. Besides, a metal cap 270*b* may also be disposed at the second sealed end S2. The metal caps 270*a* and 270*b* are disposed to protect the lamp tube 210 and electrically contact a plug, so as to install the dielectric barrier discharge lamp 200 on a lamp base. Additionally, the metal caps 270*a* and 270*b* may be electrically connected to the second electrode 250, so that a voltage can be supplied to the second electrode 250 through the metal caps 270*a* and 270*b*.

If the protruding portion 212 of the lamp tube 210 is disposed on the axis of the lamp tube 210 and at the first sealed end S1 and protrudes toward the outside of the lamp tube 210, the metal cap 270*a* covering the first sealed end S1 also covers the protruding portion 212. In order to prevent the metal cap 270*a* from getting too close to the first terminal 240*a* of the first electrode 240 (which may cause gas discharge and accordingly damage the metal cap 270*a*), while determining the length x of the gap 234 (the area in FIG. 2A indicated with diagonal lines) in the support member 230, the sum of the length x of the gap 234 and the length y of the protruding portion 212 should be greater than a half of the external diameter of the lamp tube 210. Thus, the distance between the first electrode 240 and the second electrode 250 is smaller than the distance between the first electrode 240 and the metal cap 270*a*, so that abnormal discharge between the first electrode 240 and the metal cap 270*a* is avoided. To be specific, if the metal cap 270*a* covers a portion of the first electrode 240, the metal cap 270*a* correspondingly shields part of the illumination produced by gas discharge. Thus, by setting the length x of the gap 234 in the accommodating space 232 appropriately, the length of the first electrode 240 in the support member 230 can be adjusted and accordingly the metal cap 270*a* is prevented from shielding too much emitted light.

Additionally, an electric insulator 274 can be respectively filled between the metal caps 270*a* and 270*b* and the first sealed end S1 and the second sealed end S2 of the lamp tube 210. At the second sealed end S2, to prevent the second terminal 240*b* of the first electrode 240 from directly contacting the metal cap 270*b* (which may cause a short circuit between the first electrode 240 and the second electrode 250) when it protrudes out of the lamp tube 210 through the transition glass layer 214, the electric insulator 274 is filled between the lamp tube 210 and the metal cap 270*b*. Meanwhile, an electric insulation layer 272 covers the first electrode 240 at where the first electrode 240 is connected with the metal cap 270*b*, so that the metal cap 270*b* will not directly contacts the first electrode 240 due to the insulation of the electric insulation layer 272. The electric insulator 274 and the electric insulation layer 272 may be made of a ceramic insulating cement or a plastic material. Other aspects of the dielectric barrier discharge lamp 200 can be referred to descriptions related to the dielectric barrier discharge lamp 100 therefore will not be described herein.

Figure 2B:
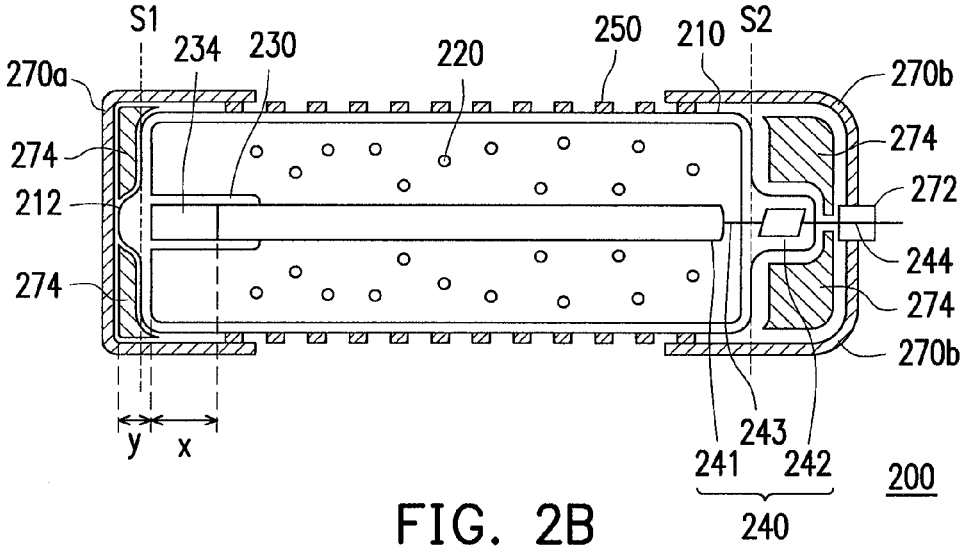
FIG. 2B is a diagram of a dielectric barrier discharge lamp according to another embodiment of the disclosure.

FIG. 2B is a diagram of a dielectric barrier discharge lamp according to another embodiment of the disclosure. Similar to that illustrated in FIG. 1B, the first electrode 240 in the lamp tube 210 includes a rod-shaped conductor 241 and a plate-shaped conductor 242. The rod-shaped conductor 241 and the plate-shaped conductor 242 are electrically connected with each other through a small metal rod 243, and the plate-shaped conductor 242 is further electrically connected to another small metal rod 244 and extended out of the lamp tube 210. In order to prevent the small metal rod 244 from directly contacting the metal cap 270*b* (which may cause short circuit between the first electrode 240 and the second electrode 250), the electric insulation layer 272 is disposed around where the small metal rod 244 is connected with the metal cap 270*b*. The plate-shaped conductor 242 is compressed to closely fit the first electrode 240 and the second sealed end S2. Other dispositions can be referred to FIG. 2A and the embodiments described above therefore will not be described herein.

Based on the embodiment described above, the main feature of the dielectric barrier discharge lamp 200 is that the first sealed end S1 is covered with the metal cap 270*a*. In addition, the second sealed end S2 may also be covered with the metal cap 270*b*. Thus, the dielectric barrier discharge lamp 200 can have the same design as that illustrated in FIG. 1D. Namely, a phosphor coating (not shown) can be applied on the inner surface or the outer surface of the lamp tube 210 to emit lights of different wavelengths. The dielectric barrier discharge lamp 200 can also have the design illustrated in FIG. 1E. Namely, the protruding portion 212 can be formed on the sidewall of the lamp tube 210 instead of on the axis of the lamp tube 210. It should be noted that if the protruding portion 212 is not formed on the axis of the lamp tube 210, the length x of the gap 234 should still be around half of the external diameter of the lamp tube 210 in order to prevent abnormal gas discharge between the metal cap 270*a* and the first electrode 240.

Figure 3A:
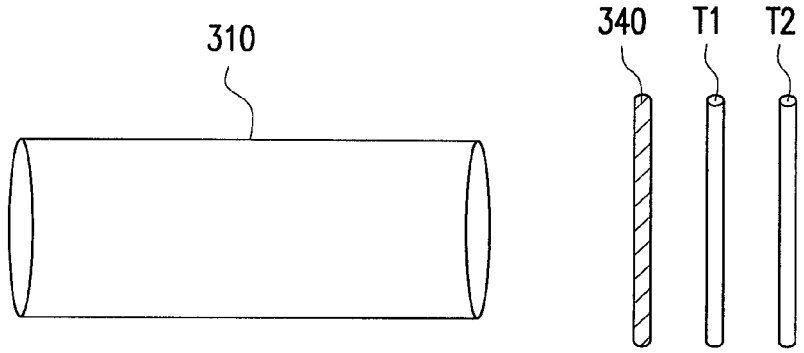
FIGS. 3A-3I illustrate a fabrication method of a dielectric barrier discharge lamp according to an embodiment of the disclosure.
Figure 3B:
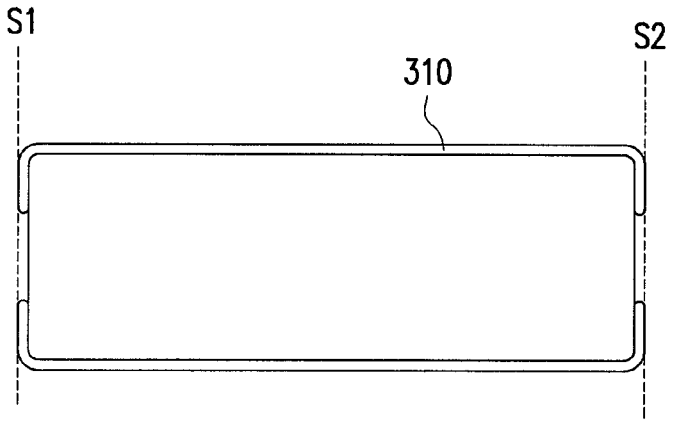
Figure 3C:
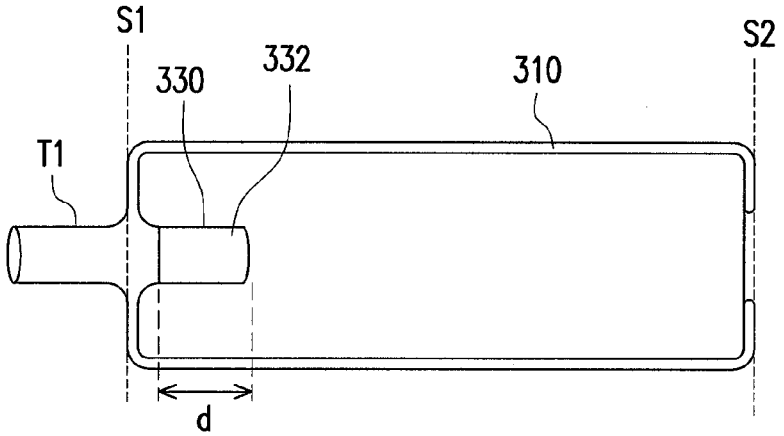
Figure 3D:
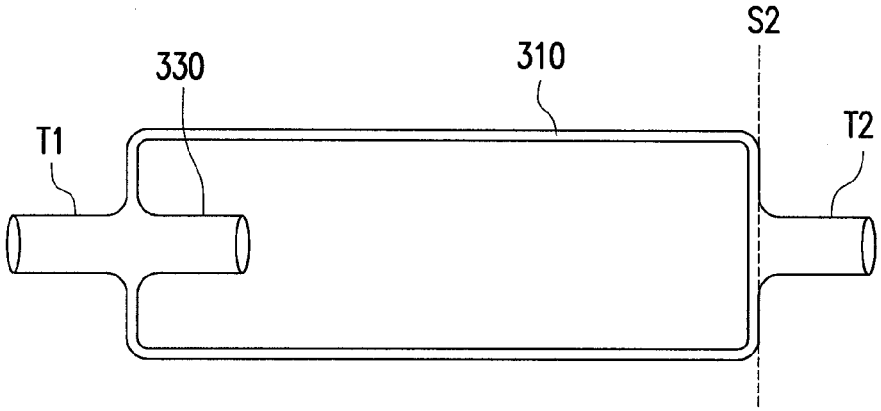
Figure 3E:
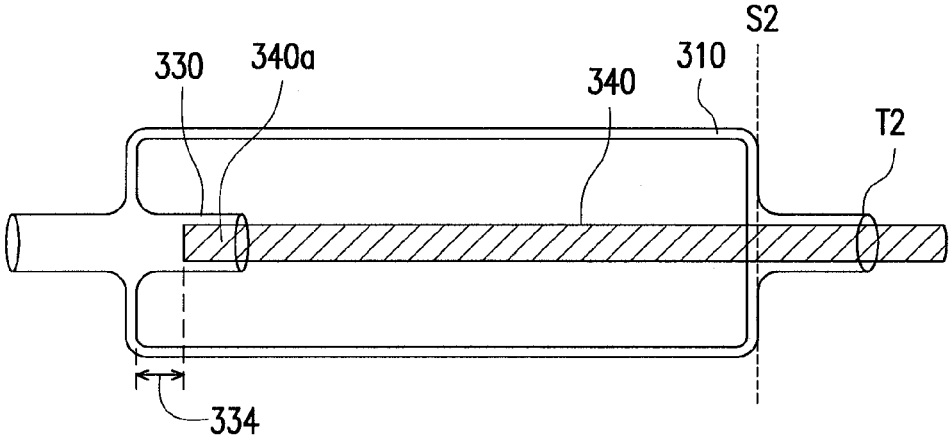

FIGS. 3A-3I illustrate a fabrication method of a dielectric barrier discharge lamp according to an embodiment of the disclosure. In FIG. 3A, a lamp tube 310, a first electrode 340, a first side tube T1, and a second side tube T2 are prepared. In FIG. 3B, a first sealed end S1 and a second sealed end S2 are respectively formed at both ends of the lamp tube 310 through tube expanding and/or tube shrinking. In FIG. 3C, the first side tube T1 is inserted into the first sealed end S1 of the lamp tube 310 and advanced in the lamp tube 310 for a predetermined distanced. Then, the outer surface of the first side tube T1 and the first sealed end S1 are connected with each other to fix the first side tube T1 at the first sealed end S1, and a tube-shaped support member 330 is formed inside the lamp tube 310. The support member 330 is part of the first side tube T1 and has an accommodating space 332 because of its tube shape. In FIG. 3D, an opening of the second side tube T2 is fixed to the second sealed end S2 of the lamp tube 310, and the second side tube T2 and the lamp tube 310 are internally connected. In FIG. 3E, the first electrode 340 is placed into and fixed to the second sealed end S2 through the inside of the second side tube T2, so that a part of the first electrode 340 is left outside of the lamp tube 310 and another part of the first electrode 340 is extended into the support member 330. There is a gap 334 between the end of the first terminal 340*a* of the first electrode 340 extended into the support member 330 and the first sealed end S1.

Figure 3F:
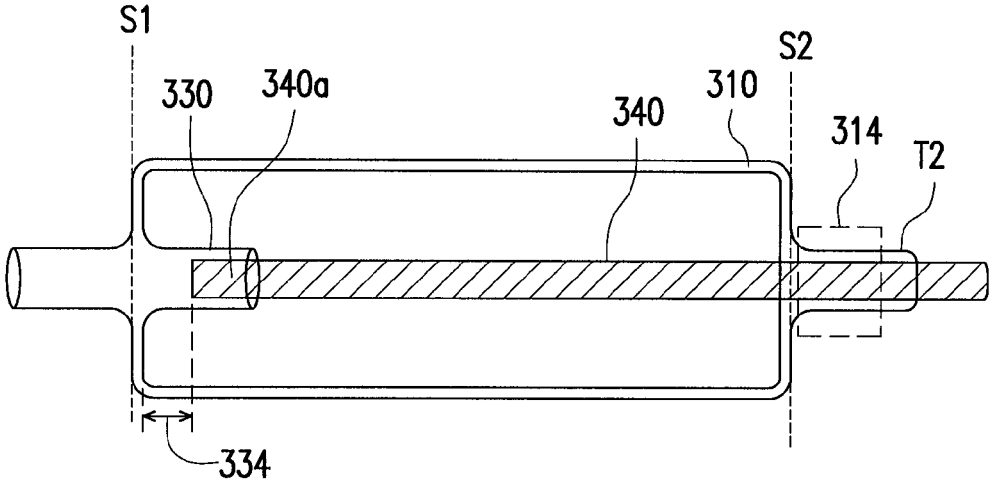

In FIG. 3F, the second side tube T2 is sealed to closely fit the second side tube T2 and the first electrode 340. It should be noted that there are two techniques for sealing the second side tube T2 at the second sealed end S2. One technique is to compress and deform the second side tube T2 with the first electrode 340 so that the first electrode 340 and the second side tube T2 are closed fitted with each other at the second sealed end S2. The other technique is to dispose a transition glass layer 314 (as shown in FIG. 3F) at the second side tube T2 at the second sealed end S2 and/or on the first electrode 340, so that the first electrode 340 is closely fitted and fixed to the second side tube T2 (i.e., the second sealed end S2) through the transition glass layer 314. These two techniques can be respectively referred to FIGS. 1C and 1A therefore will not be described herein.

Figure 3G:
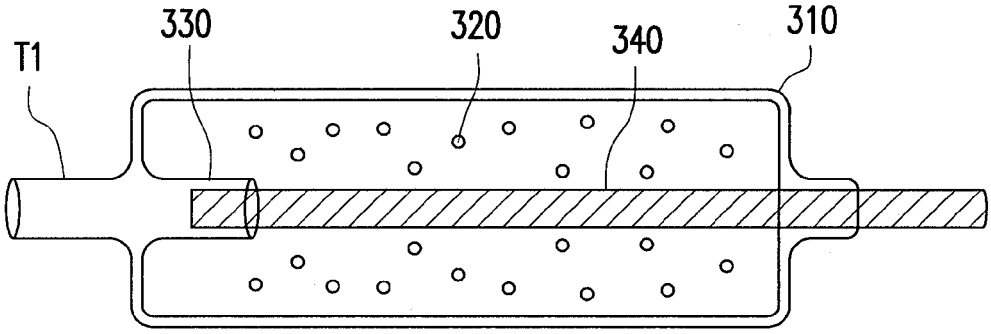
Figure 3H:
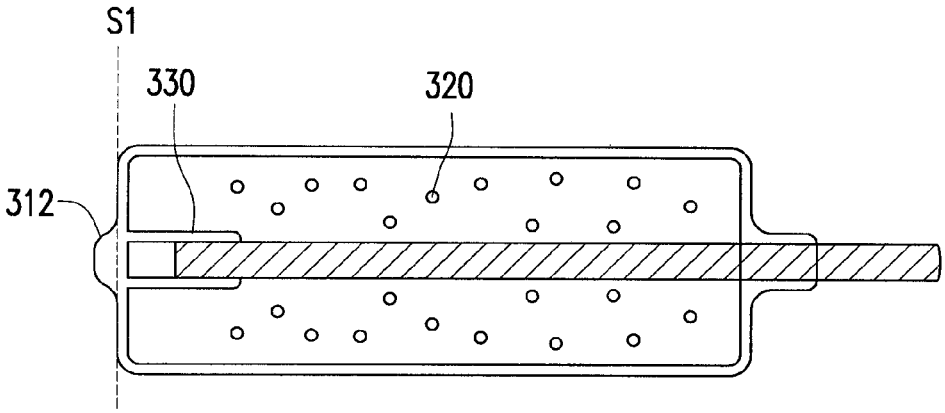
Figure 3I:
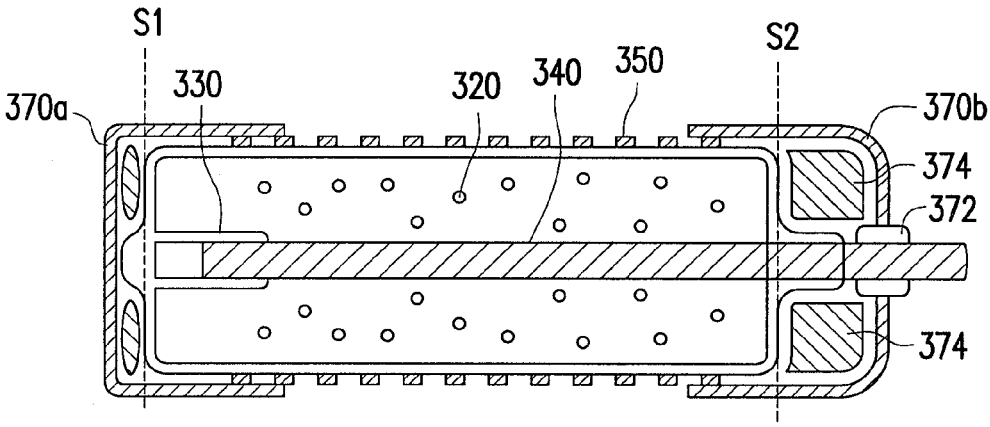

In FIG. 3G, the inside of the lamp tube 310 is vacuum degassed and subsequently filled with a discharge gas 320 through the first side tube T1. In FIG. 3H, the first sealed end S1 is sealed to form a protruding portion 312 at the first sealed end S1. This dielectric barrier discharge lamp fabrication method further includes following steps. As shown in FIG. 3I, a second electrode 350 is disposed outside the lamp tube 310, the first sealed end S1 is covered with a metal cap 370*a*, and the metal cap 370*a* is electrically connected to the second electrode 350. In addition, the second sealed end S2 may be covered with a metal cap 370*b*, and the metal cap 370*b* may be electrically connected to the second electrode 350. An electric insulator 374 is respectively filled between the metal caps 370*a* and 370*b* and the first sealed end S1 and the second sealed end S2, and an electric insulation layer 372 is disposed between the metal cap 370*b* and the first electrode 340.

Figure 4A:
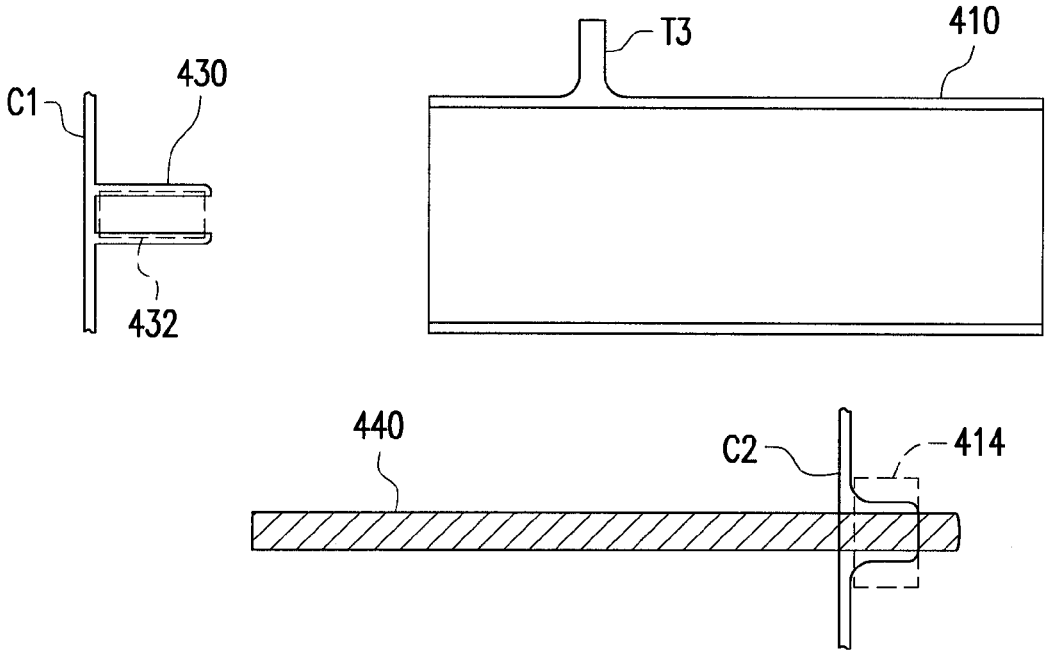
FIGS. 4A-4F illustrate a fabrication method of a dielectric barrier discharge lamp according to an embodiment of the disclosure.

FIGS. 4A-4F illustrate a fabrication method of a dielectric barrier discharge lamp according to an embodiment of the disclosure. In FIG. 4A, a lamp tube 410 with a side discharging vent T3, a first electrode 440, a first side cover C1, and a second side cover C2 are provided. The first side cover C1 has a support member 430, the support member 430 has an accommodating space 432, and the first electrode 440 is fixed and closely fitted to the second side cover C2.

The disclosure provides several techniques for fixing the first electrode 440 to the second side cover C2. One of the techniques is to compress the first electrode 440 with the second side cover C2 to fix the first electrode 440, and another technique is to dispose a transition glass layer 414 on the second side cover C2 and/or on the first electrode 440. As described in the embodiment illustrated in FIG. 1A, the first electrode 440 is closely fitted and fixed to the second side cover C2 through the transition glass layer 414 (as shown in FIG. 4A).

Figure 4B:
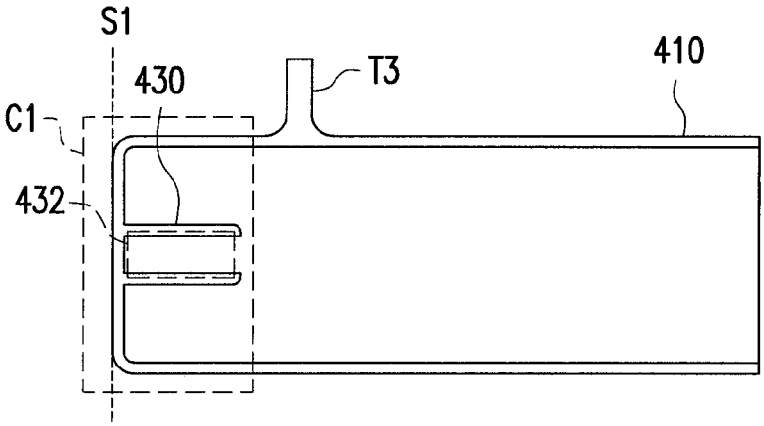
Figure 4C:
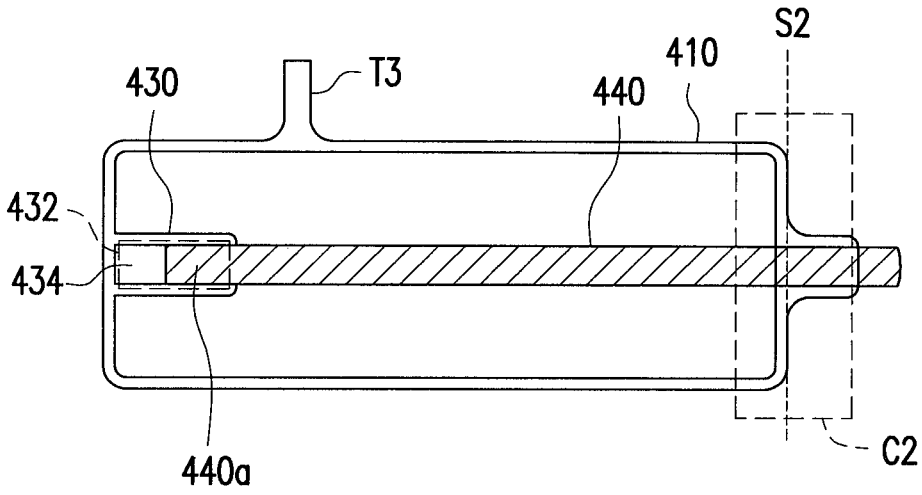
Figure 4D:
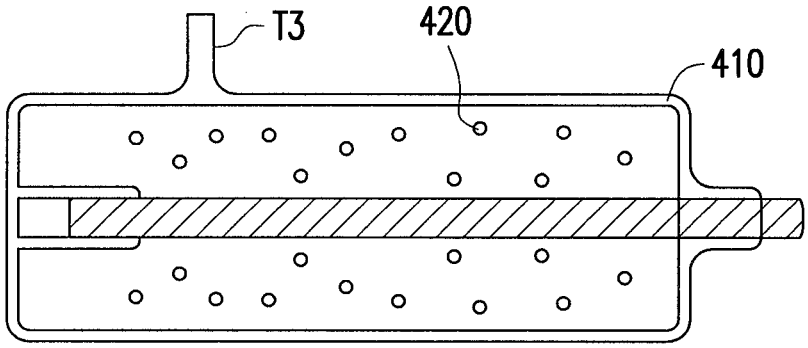
Figure 4E:
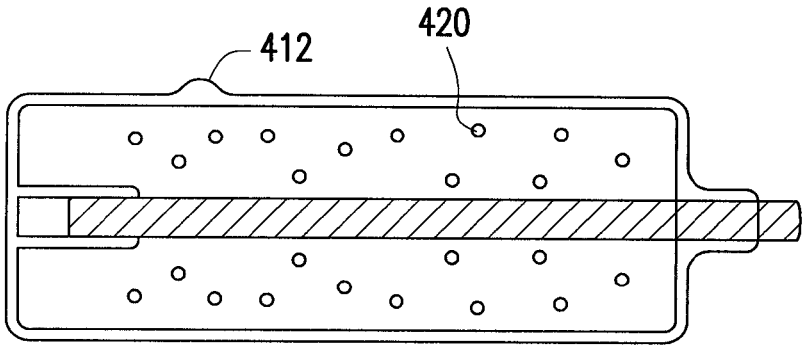

In FIG. 4B, the first sealed end S1 is formed at one end of the lamp tube 410, and the first side cover C1 is fixed to the first sealed end S1, the support member 430 of the first side cover C1 is extended from the first sealed end S1 toward the inside of the lamp tube 410, and the opening of the accommodating space 432 faces the inside of the lamp tube 410. In FIG. 4C, the second sealed end S2 is formed at the end of the lamp tube 410 that is opposite to the end of the first sealed end S1, the second side cover C2 is fixed to the second sealed end S2. The first electrode 440 penetrates the second sealed end S2, and the first terminal 440*a* of the first electrode 440 passes through the opening of the accommodating space 432 so that part of the first electrode 440 is in the support member 430. In other words, the first electrode 440 is closely fixed to and penetrates the second side cover S2 by means of compressing the second side cover S2 to contact with the first electrode 440. Besides, there is a gap 432 between the end of the first terminal 440*a* of the first electrode 440 and the closed end of the support member 430. A second terminal of the first electrode 440 is toward outside of the lamp tube 410. In FIG. 4D, the inside of the lamp tube 410 is vacuum degassed and subsequently filled with a discharge gas 420 through the side discharging vent T3 on the lamp tube 410. In FIG. 4E, the side discharging vent T3 is sealed to form a protruding portion 412.

Figure 4F:
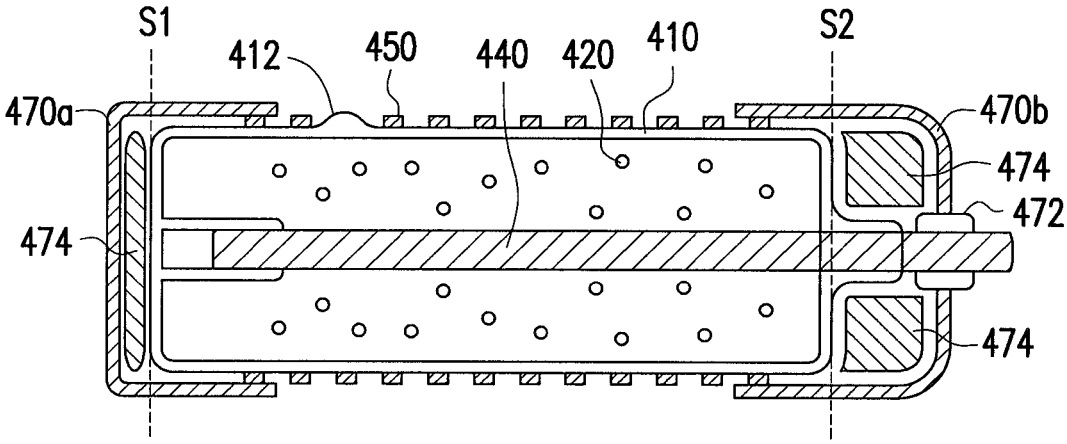

Additionally, in the dielectric barrier discharge lamp fabrication method, as shown in FIG. 4F, a second electrode 450 is disposed outside the lamp tube 410, the first sealed end S1 is covered by a metal cap 470*a*, and the metal cap 470*a* is electrically connected to the second electrode 450. The second sealed end S2 of the lamp tube 410 may be covered by a metal cap 470*b*, and the metal cap 470*b* is electrically connected to the second electrode 450. An electric insulator 474 is respectively filled between the metal caps 470*a* and 470*b* and the first sealed end S1 and the second sealed end S2, and an electric insulation layer 472 is disposed between the metal cap 470*b* and the first electrode 440.

As described above, in a dielectric barrier discharge lamp provided by an embodiment of the disclosure, a support member is disposed to position a first electrode, and a gap is maintained between the first electrode and the support member. When the first electrode is heated and expands, the gap can accommodate the expansion of the first electrode, so that the first electrode is prevented from being deformed or twisted. In addition, by disposing a side discharging vent, a side tube, or the support member, a discharge gas can be conveniently filled. Moreover, a dielectric barrier discharge lamp provided by the disclosure can be fabricated through simple fabrication and assembly processes. Thereby, the fabrication cost of the dielectric barrier discharge lamp is reduced.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A dielectric barrier discharge lamp, comprising:

a lamp tube, having a first sealed end and a second sealed end;

a discharge gas, filled in the lamp tube;

a support member, disposed at the first sealed end, and extended from the first sealed end toward an inside of the lamp tube, wherein the support member has an accommodating space, and an opening of the accommodating space faces the inside of the lamp tube;

a first electrode, disposed from inside to outside of the lamp tube, wherein a part of the first electrode inside the lamp tube is exposed to the discharge gas and a first terminal of the first electrode passes through the opening of the accommodating space so that another part of the first electrode inside the lamp tube is in the accommodating space, and a gap exists between an end of the first terminal of the first electrode and a closed end of the accommodating space, while a second terminal of the first electrode penetrates the second sealed end to outside of the lamp tube and is directly contact and closely fitted with the second sealed end; and a second electrode, disposed outside the lamp tube.

2. The dielectric barrier discharge lamp according to claim 1, wherein a length of the gap is greater than a half of an external diameter of the lamp tube.

3. The dielectric barrier discharge lamp according to claim 1, wherein a length of the gap is at least 1 mm.

4. The dielectric barrier discharge lamp according to claim 1, wherein within a temperature range, a length of the gap is greater than a length variation of the first electrode caused by thermal expansion.

5. The dielectric barrier discharge lamp according to claim 1, wherein the accommodating space is a tube-shaped space, and the accommodating space and the lamp tube have a same axis.

6. The dielectric barrier discharge lamp according to claim 1, wherein the first electrode and the lamp tube have a same axis.

7. The dielectric barrier discharge lamp according to claim 1 further comprising a protruding portion, wherein the protruding portion is on the lamp tube and protrudes toward an outside of the lamp tube.

8. The dielectric barrier discharge lamp according to claim 7, wherein the protruding portion is on an axis of the lamp tube, disposed at the first sealed end, and protrudes toward the outside the lamp tube, and a sum of a length of the protruding portion and a length of the gap is greater than a half of an external diameter of the lamp tube.

9. The dielectric barrier discharge lamp according to claim 7 further comprising a metal cap, wherein the metal cap covers the first sealed end.

10. The dielectric barrier discharge lamp according to claim 9, wherein the metal cap is electrically connected to the second electrode.

11. The dielectric barrier discharge lamp according to claim 9, wherein the protruding portion is on an axis of the lamp tube, disposed at the first sealed end, and protrudes toward the outside of the lamp tube, and the metal cap covering the first sealed end covers the protruding portion.

12. The dielectric barrier discharge lamp according to claim 9 further comprising an electric insulator filled between the metal cap and the first sealed end.

13. The dielectric barrier discharge lamp according to claim 1, wherein the first electrode is a rod-shaped conductor or a plate-shaped conductor.

14. The dielectric barrier discharge lamp according to claim 1, wherein the first electrode comprises a rod-shaped conductor and a plate-shaped conductor.

15. The dielectric barrier discharge lamp according to claim 14, wherein the plate-shaped conductor is compressed with the lamp tube at the second sealed end, and the rod-shaped conductor is electrically connected to the plate-shaped conductor.

16. The dielectric barrier discharge lamp according to claim 1, wherein the second sealed end of the lamp tube comprises a transition glass layer, and the second terminal of the first electrode is closely fitted with the second sealed end through the transition glass layer.

17. The dielectric barrier discharge lamp according to claim 1, wherein the second electrode has a plurality of light-transmissive openings.

18. The dielectric barrier discharge lamp according to claim 1, wherein the opening of the accommodating space is circular or polygonal.

19. The dielectric barrier discharge lamp according to claim 1, wherein an inner surface or an outer surface of the lamp tube has a phosphor coating.

20. A fabrication method of a dielectric barrier discharge lamp, comprising:

providing a lamp tube, a first electrode, a first side tube, and a second side tube;

forming a first sealed end and a second sealed end at both ends of the lamp tube;

inserting the first side tube into the first sealed end of the lamp tube and advancing the first side tube toward an inside of the lamp tube for a predetermined distance, and connecting an outer surface of the first side tube to the first sealed end to form a tube-shaped support member inside the lamp tube;

fixing an opening of the second side tube to the second sealed end of the lamp tube, and internally connecting the second side tube and the inside of the lamp tube;

placing and fixing the first electrode at the second sealed end through the second side tube, so that a first part of the first electrode is outside the lamp tube and a second part of the first electrode is inside the support member, wherein a gap exists between an end of a first terminal of the first electrode in the support member and the first sealed end;

sealing the second side tube so that the second side tube and the first electrode are directly contact and closely fitted with each other;

vacuum degassing and filling a discharge gas into the lamp tube through the first side tube, wherein a third part of the first electrode inside the lamp tube is exposed to the discharge gas; and sealing the first side tube to form a protruding portion at the first sealed end.

21. The fabrication method according to claim 20, wherein the step of sealing the second side tube comprises:

compressing the second side tube with the first electrode so that the first electrode and the second side tube are closed fitted with each other at the second sealed end.

22. The fabrication method according to claim 20, wherein the step of sealing the second side tube comprises:

at the second sealed end, disposing an transition glass layer at the second side tube and/or on the first electrode, wherein the first electrode is closely fitted with the second side tube through the transition glass layer.

23. The fabrication method according to claim 20 further comprising:

disposing a second electrode outside the lamp tube; and covering the first sealed end with a metal cap, wherein the metal cap is electrically connected to the second electrode.

24. A fabrication method of a dielectric barrier discharge lamp, comprising:

providing a lamp tube, a first electrode, a first side cover, and a second side cover, wherein the lamp tube has a side discharging vent, the first side cover has a support member with an accommodating space, and the first electrode is directly contact and closely fixed to the second side cover, and penetrates the second side cover;

forming a first sealed end at an end of the lamp tube, and fixing the first side cover at the first sealed end, wherein the support member of the first side cover is extended from the first sealed end toward an inside of the lamp tube, and an opening of the accommodating space faces the inside of the lamp tube;

forming a second sealed end at an end of the lamp tube opposite to the first sealed end, and fixing the second side cover to the second sealed end, wherein a first terminal of the first electrode passes through the opening of the accommodating space so that a part of the first electrode is in the support member, a gap exists between an end of the first terminal of the first electrode and a closed end of the support member, and a second terminal of the first electrode is toward outside of the lamp tube;

vacuum degassing inside of the lamp tube and subsequently filling a discharge gas into the lamp tube through the side discharging vent of the lamp tube, wherein another part of the first electrode inside the lamp tube is exposed to the discharge gas; and sealing the side discharging vent to form a protruding portion.

25. The fabrication method according to claim 24, wherein the first electrode is closely fixed to and penetrates the second side cover by means of compressing the second side cover to contact with the first electrode.

26. The fabrication method according to claim 24, wherein the second side cover comprises a transition glass layer, and the first electrode is closely fitted to the second side cover through the transition glass layer.

27. The fabrication method according to claim 24 further comprising:

disposing a second electrode outside the lamp tube; and covering the first sealed end with a metal cap, wherein the metal cap is electrically connected to the second electrode.

* * * * *